United States Patent [19]

Hawkins

[11] 4,140,279

[45] Feb. 20, 1979

[54] SPRAY GUN

[76] Inventor: Robert D. Hawkins, 115 Stoney Hollow Rd., Centreport, N.Y. 11721

[21] Appl. No.: 849,611

[22] Filed: Nov. 8, 1977

[30] Foreign Application Priority Data

Nov. 13, 1976 [GB] United Kingdom ..... 47391/76

[51] Int. Cl.[2] ..... B05B 15/06

[52] U.S. Cl. ..... 239/309; 239/272; 239/345

[58] Field of Search ..... 239/272, 309, 345

[56] References Cited

U.S. PATENT DOCUMENTS

| | | | |
|---|---|---|---|
| 2,593,552 | 4/1952 | Folkman | 239/309 |
| 2,961,335 | 11/1960 | Shepard | 239/345 |
| 3,554,450 | 1/1971 | D'Muhala | 239/309 X |

*Primary Examiner*—Robert W. Saifer

*Attorney, Agent, or Firm*—Cushman, Darby & Cushman

[57] ABSTRACT

A spray gun for spraying viscous liquids such as resin has a pistol-grip handle on which a lidded container is cradled with a peripheral skirt of the lid clamped against a spray nozzle head, so that a nozzle inlet tube communicates with the container. Liquid is sprayed by compressed air supplied to the nozzle through the handle under control of a valve on the handle.

10 Claims, 4 Drawing Figures

SPRAY GUN

This invention relates to a spray gun, particularly for use in the spraying of viscous liquids such as gel-coat resins and plaster.

Gel-coat resins when mixed with catalyst (hardener) remain liquid for a few minutes only, and spray guns are known for dispensing such resins from a small container mounted on a hand-held spray gun actuated by compressed air. By controlling the supply of compressed air to the nozzle by means of a suitable valve on the gun it is possible to regulate the spraying of resin from the nozzle onto a surface to be coated.

In order that such a spray gun may be sufficiently light to be held in the hand the container for the resin is necessarily small. In order, therefore, to spray a large quantity of resin, For example in the construction of a glass fibre reinforced plastics (GRP) boat hull it is necessary to refill the container frequently, or alternatively to replace each empty container with a full one. To facilitate such changing of the resin container previously known spray guns of the above-mentioned type have utilized a container lid which remains attached to the spray nozzle on the gun. In order to fit a resin container to the gun the sealed cover of the container is first removed and the container lid attached to the spray gun is then pressed on to the open mouth of the container to form a tight seal. The container is held against the lid on the spray gun by means of a spring-loaded hook which engages a recess or lip in the bottom of the container. A disadvantage of this procedure is that the lid on the spray gun has to be positioned carefully and pressed so as to seat it properly upon the resin container, while the latter has to be positioned near the edge of a table or bench in order to attach the spring-loaded hook to the container after it has been fitted. Detaching and discarding an empty container is similarly difficult and messy, since it usually necessitates the removal of the lid and nozzle from the gun along with the container in order to pry off the lid without damage and without spattering resin on the gun and surrounding objects. A further disadvantage is that a special container is necessary, having a lip or recess on its bottom for engagement by the spring-loaded hook. Containers of this type are difficult to clean, and are available with suitable lids in a limited number of shapes and sizes only.

An object of the present invention is to provide an improved spray gun which is capable of use with containers having removable lids, and which can be used with containers of different sizes without the difficulties associated with previously known spray guns for use with containers having integral lids.

According to the present invention there is provided a spray gun comprising a pistol-grip handle, a cradle carried by the handle for supporting a container for the viscous liquid to be sprayed, a spray nozzle head mounted on the handle having a spray nozzle outlet and a nozzle inlet tube, a manually releasable clamp mounted on the handle and adapted to engage a peripheral skirt of a removable lid of a said container to clamp the lid and the container against the nozzle head with the nozzle inlet tube in communication with the interior of the container and with the lid sealed relative to the nozzle inlet tube, a compressed air supply conduit connected to the nozzle head and a manually operable valve on the handle for controlling the supply of compressed air to the nozzle head through said conduit in use of the gun for the purpose of entraining liquid from the container and spraying a jet of said liquid through the spray nozzle outlet.

The container lid can be sealed against the nozzle head of the spray gun in a number of ways. Preferably the nozzle inlet tube has a sharp edge such that it can pierce the lid of the container when the latter is fitted to the spray gun. A seal would be formed with the container lid by the material of the lid itself where the latter is made of plastics material, or may be provided by a suitable sealing washer where the lid is made of metal.

By providing a releasable clamp for holding the container with its lid sealed against the nozzle head, the need to provide a spring-loaded hook for holding the container itself in position is avoided, and accordingly the spray gun can be used with containers of a variety of shapes and sizes.

Preferably the cradle comprises a generally U-shaped member attached to the handle for supporting a side wall of a said container. A U-shaped bail member is preferably attached to the arms of the cradle member and disposed in a plane substantially perpendicular to the cradle member for engagement with the lid of the container when the container is supported and clamped on the gun.

The nozzle head of the spray gun may have a housing which is formed integrally with the pistol-grip handle, for example as a single aluminium casting.

The clamp preferably comprises a manually operable lever pivoted on the handle. In a preferred embodiment the clamp lever has an upstanding lip which in a clamping position of the lever engages a peripheral skirt of the container lid and clamps the latter against an abutment on the nozzle head with the lip in an overcentre position with respect to its pivot. The clamp lever may conveniently be arranged so that it can be operated by one finger of a user while holding the pistol-grip handle.

When a container mounted on the spray gun is to be changed, the clamp is released, allowing the empty container, along with its lid, to be discarded by simply withdrawing the empty container and its lid from engagement with the nozzle head. A fresh container with its lid may then be placed in position in the cradle of the spray gun, its lid pierced by the inlet tube of the nozzle and the fresh container clamped in position, without necessarily holding the container on a flat horizontal surface: since the lid remains in position on the container throughout, there is no risk of spillage and dripping as the fresh container is fitted.

When a full container has been fitted to the spray gun as described above the spray gun would normally be held with the nozzle uppermost until spraying is to be commenced, when the nozzle is brought into a generally horizontal position with the container on its side. Upon opening the valve resin is fed to the nozzle by a venturi effect, the resin being entrained by compressed air fed to the nozzle to form a spray jet.

The invention will be further described, by way of example only, with reference to the accompanying purely diagrammatic drawings, in which.

Figure 1:
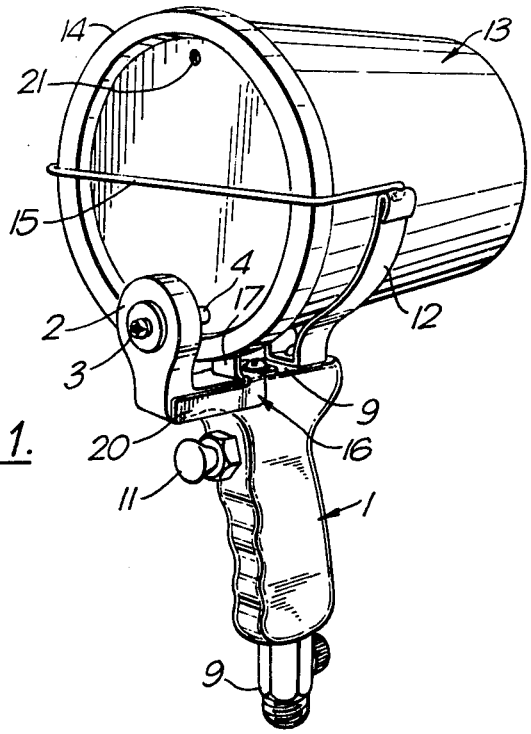
FIG. 1 is a general perspective view of a spray gun according to one embodiment of the invention shown with a lidded container fitted thereto.

The spray gun shown in the drawings is intended for spraying a viscous liquid such as gel-coat resin from a small container mounted on the gun. The spray gun has a moulded or cast pistol-grip handle 1 formed integrally with a nozzle head 2 having a housing in which a spray outlet nozzle 3 is formed. The nozzle 3 has a rearwardly projecting inlet tube 4 formed with a sharpened edge 5 by external bevelling. Between the bevelled edge 5 and the nozzle housing 2 the nozzle head 2 is formed with an annular shoulder 6.

Figure 3:
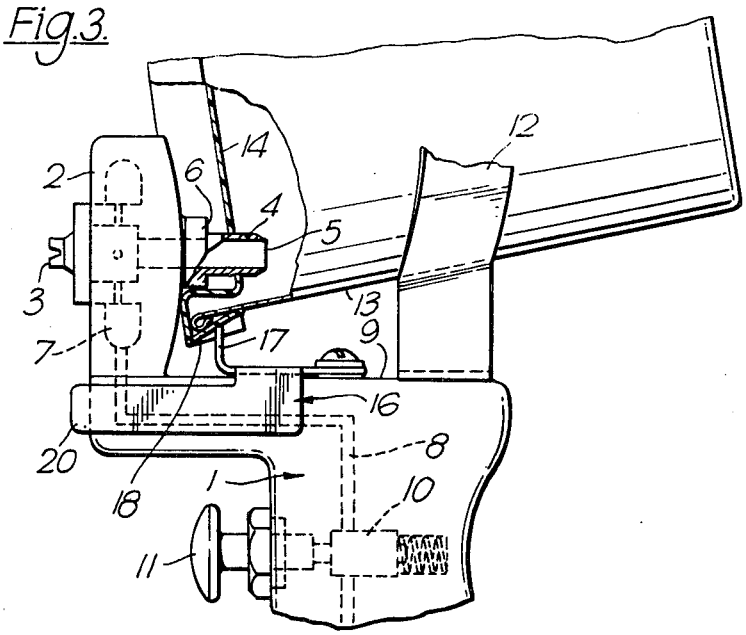
FIG. 3 is a side elevation of part of the spray gun shown in FIG. 2, showing a container with a flexible plastics lid fitted to the spray gun.

Within the nozzle head 2 an annular duct 7 is formed, shown diagrammatically in broken outline in FIG. 3, which concentrically surrounds the nozzle 3 and communicates with the latter through one or more apertures. The annular duct 7 communicates with a compressed air supply conduit 8, also shown diagrammatically in broken outline, extending through the pistol-grip handle 1 and terminating in an adaptor 9 by means of which a flexible compressed air supply line or hose may be connected to the duct 7. The compressed air supply conduit 8 within the handle 1 incorporates a normally closed spring-loaded valve 10 which can be opened by finger pressure applied to a valve button 11 located near the top of the pistol-grip handle 1.

The pistol-grip handle 1 has a flat upper surface adjoining the nozzle head 2 to which a generally U-shaped container support cradle 12 is secured centrally by means of a screw. The support cradle 12 has curved arms adapted and shaped to support the curved side walls of a container 13 closed by a tightly fitting lid 14. The container support cradle 12 supports at the ends of its two arms a generally U-shaped bail member 15 of metal wire disposed in a plane perpendicular to the plane of the cradle arms and shaped so as to support the container lid 14 when the container 13 is correctly positioned in the cradle 12, as shown in FIG. 1.

With the container 13 correctly positioned in the support cradle 12 the inlet tube 4 of the nozzle head 2 engages the lid 14 of the container 13. By pushing the container 13 against the nozzle head 2, the tube 4 pierces the container lid 14 to place the nozzle 3 in communication with the resin or other viscous liquid in the container.

Figure 2:
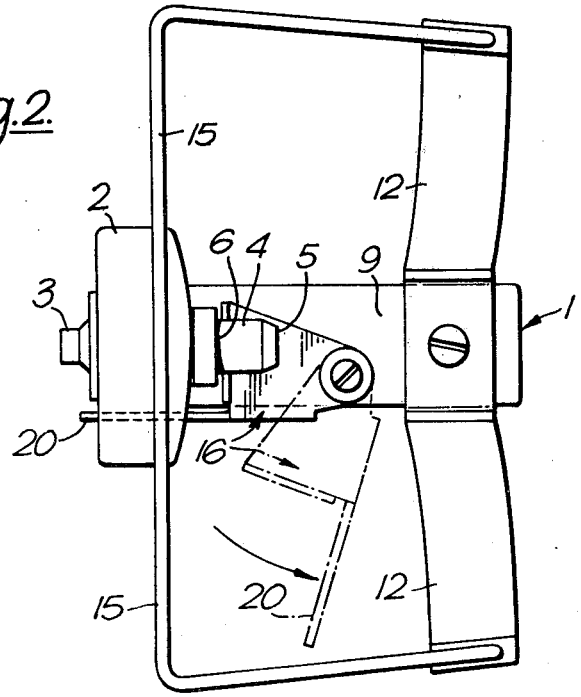
FIG. 2 is a plan view of the spray gun shown in FIG. 1, with the container removed.

To assist in the piercing of the lid 14, and to retain the container 13 firmly in position against the nozzle head 2, the spray gun is provided with a manually operable clamp which in the illustrated embodiment comprises a pivoted clamp lever 16 mounted on the flat upper surface of the handle 1. The clamp lever 16 is formed with an upstanding integral lip 17 which can be brought into engagement with a peripheral skirt 18 of the container lid 14 which fits over a rim of the container 13 to hold the lid 14 firmly against the shoulder 6 on the nozzle head 2. The clamp lever 16 is shown in its engaged or clamping position in FIGS. 2, 3 and 4, and in a released position, in broken outline, in FIG. 2.

Figure 4:
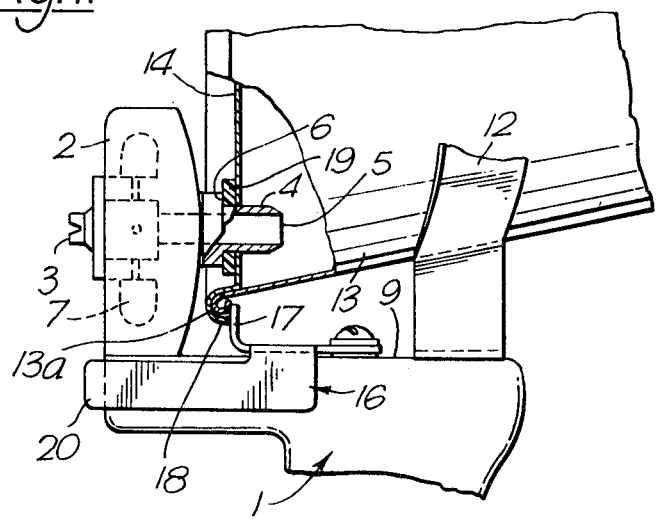
FIG. 4 is a side elevation similar to FIG. 3 showing the spray gun supporting a container with a metal lid.

Where, as shown in FIG. 3, the container 13 has a flexible plastics lid 14 and the peripheral skirt 18 is resiliently flexible the upstanding lip 17 of the lever 16 engages the skirt 18 and presses the latter against the container wall, while also pressing the lid 14 against the nozzle 2, as shown in FIG. 3. The nozzle inlet tube 4 pierces the flexible plastics lid 14 and is sealed relative to the latter by virtue of the soft plastics material from which the lid 14 is made.

Where the container 13 has a lid 14 of metal, as shown in FIG. 4, sealing between the nozzle inlet tube 4 which pierces the container lid 14 and the lid 14 itself is effected by means of a sealing washer 19 interposed between the shoulder 6 and the lid 14 itself. In this case the upstanding lip 17 of the clamp lever 16 engages the peripheral skirt 18 of the lid 14 and an outwardly turned rim 13*a* of the container 13, holding the container 13 and its lid 14 firmly in position with the container lid 14 abutting the nozzle head 2 through the interposed washer 19.

The clamp lever 16 has an integral operating arm 20 which in the clamped position of the lever 16 lies immediately below the nozzle housing 2 and flat against one side of the handle 1. The lever 16 can be closed by light finger pressure on the lever arm 20 and is held in its closed position by friction and/or by the lever arm 20 being slightly over center with respect to its pivot axis. By pulling the lever arm 20 away from the handle 1 the lever 16 can be rotated away from the nozzle housing 2 into an unclamped position, shown in broken outline in FIG. 2, in which the container 13 and its lid 14 are disengaged, permitting easy removal of the container and the lid for replacement by a full container.

Before using the spray gun the operator would make a vent hole 21 in the container lid 14 diametrically opposite the hole made by the nozzle inlet tube 4 to allow entry of air as liquid is discharged from the container 13.

When using the spray gun the operator would normally hold the pistol-grip handle 1 horizontal, with the container lid 14 uppermost, until spraying is to be commenced, when the pistol-grip handle 1 will be moved into a vertical position, with the container lid 14 in a generally vertical plane, as shown in FIG. 1. In this position the resin in the container 13 will be fed under gravity to the nozzle 3. The operator depresses the button 11, opening the valve 10 in the compressed air supply conduit to cause air to be supplied to the nozzle 3, entraining resin and producing a fine spray jet of resin which is directed onto the object or work from a distance of a few feet.

It should be noted that it is not essential to have a gravity feed of a resin or other liquid from the container 13 to the nozzle, since the action of the compressed air flowing through the nozzle 3 will draw liquid from the container by a venturi effect and expel it through the nozzle. Thus the container 13 could be carried below the nozzle in positions of use of the spray gun.

I claim:

1. A spray gun for spraying viscous liquids, comprising in combination:

a pistol-grip handle, a cradle carried by the handle for supporting a container for the viscous liquid to be sprayed, the container having a removable lid with a peripheral skirt, a spray nozzle head mounted on the handle having a spray nozzle outlet and a nozzle inlet tube, a manually releasable clamp mounted on the handle and adapted to engage the peripheral skirt of said removable lid of the container to clamp the lid and the container against the nozzle head with the nozzle inlet tube in communication with the interior of the container and with the lid sealed relative to the nozzle inlet tube, a compressed air supply conduit connected to the nozzle head and a manually operable valve carried by said handle for controlling the supply of compressed air to the nozzle head through said conduit in use of the gun for the purpose of entraining liquid from the container and spraying a jet of said liquid through the spray nozzle outlet.

2. The spray gun defined in claim 1, wherein the cradle comprises a generally U-shaped member attached to the handle for supporting a side wall of a said container.

3. The spray gun defined in claim 2, including a U-shaped bail member attached to the arms of the cradle member and disposed in a plane substantially perpendicular to the cradle member for engagement with the lid of the container when the container is supported and clamped on the gun.

4. The spray gun defined in claim 1, wherein the nozzle head has a housing which is formed integrally with the handle.

5. The spray gun defined in claim 1, wherein the clamp comprises a manually operable lever pivoted on the handle.

6. The spray gun defined in claim 5, wherein the clamp lever has an upstanding lip which in a clamping position of the lever engages a peripheral skirt of the container lid and clamps the latter against an abutment shoulder on the nozzle head with the lip in an overcentre position with respect to its pivot.

7. The spray gun defined in claim 5, wherein the clamp lever is pivoted about an axis perpendicular to the nozzle axis and has a lever arm which in the clamping position of the lever lies alongside the nozzle head.

8. A spray gun for spraying viscous liquids, comprising:

a pistol-grip handle, a container having a removable lid sealed thereon, the lid having a peripheral skirt, a cradle carried by the handle and supporting the container, a spray nozzle head mounted on the handle and having a spray nozzle outlet and a nozzle inlet tube, a manually releasable clamp mounted on the handle and engaging the peripheral skirt of said lid to clamp the lid against the nozzle head with the nozzle outlet tube in communication with the interior of the container and with the lid sealed relative to the nozzle inlet tube, a compressed air supply conduit connected to the nozzle head and a manually operable valve carried by said handle for controlling the supply of compressed air to the nozzle head through said conduit in use of the gun for the purpose of entraining liquid from the container and spraying a jet of said liquid through the spray nozzle outlet.

9. The spray gun defined in claim 8, wherein the lid of the container has a vent hole spaced from the nozzle inlet tube for the admission of air as liquid is discharged from the container.

10. The spray gun defined in claim 8, wherein the lid is of flexible plastics material and has a flexible resilient skirt which fits over an open end of the container, the skirt being engaged and resiliently deformed by the releasable clamp which clamps the lid against the nozzle head and also clamps the skirt against the container wall to assist in maintaining the lid on the container.

* * * * *